United States Patent [19]

Dzaack

[11] 4,210,799

[45] Jul. 1, 1980

[54] ELECTRIC HEATING UNITS

[75] Inventor: Walter J. Dzaack, Glenshaw, Pa.

[73] Assignee: Emerson Electric Co., St. Louis, Mo.

[21] Appl. No.: 948,569

[22] Filed: Oct. 4, 1978

[51] Int. Cl.[2] ..... H05B 3/08

[52] U.S. Cl. ..... 219/541; 219/451; 338/221; 338/241

[58] Field of Search ..... 219/436, 451, 452, 465, 219/523, 541, 552; 338/221, 241, 242, 273, 274, 1; 29/614; 339/217

[56] References Cited

U.S. PATENT DOCUMENTS

| | | | |
|---|---|---|---|
| 2,455,186 | 11/1948 | McCormick | 338/241 X |
| 2,494,333 | 1/1950 | Daly | 338/241 X |
| 2,641,317 | 6/1953 | Tuttle | 338/241 X |
| 2,876,322 | 3/1959 | Boggs | 338/241 X |
| 3,167,736 | 1/1965 | Temple | 338/221 |
| 3,197,617 | 7/1965 | Gillespie et al. | 219/541 |
| 3,447,121 | 5/1969 | Ammerman et al. | 219/251 X |
| 3,920,963 | 11/1975 | Bensley et al. | 219/523 |
| 4,010,350 | 3/1977 | Cunningham | 219/465 |

*Primary Examiner*—Volodymyr Y. Mayewsky
*Attorney, Agent, or Firm*—Michael Williams

[57] ABSTRACT

The invention is directed to a termination for a surface unit having a flat spiralled active heating portion and a single, downward and laterally-extending terminal leg. The termination is particularly adapted for a surface unit of the type shown in U.S. Pat. No. 4,010,350, issued Mar. 1, 1977, to Donald M. Cunningham, and assigned to the assignee of this application.

4 Claims, 4 Drawing Figures

ELECTRIC HEATING UNITS

BACKGROUND AND SUMMARY

In the said Cunningham patent, the surface unit comprises a spiralled metal tube having one closed end, and containing compacted refractary insulation and a helical resistor coil. The coil is insulated from the metal tube by the refractory insulation and is connected at one end to a central return conductor. The terminations for the coil and return conductor both extend from the end of the tube opposite the said closed end. The surfact unit is so constructed that in the event of a failure of the heating element, the failure will be in a passive manner.

Because the terminals for the coil and return conductor both extend from one end of the sheath, dielectric clearance between the two and the sheath presented a problem. My invention overcomes this problem and provides a sealed terminal connector that is adapted to be plugged into a receptacle of presently-used form, such as shown in U.S. Pat. No. 3,447,121, issued May 27, 1969, to G. E. Ammerman and D. M. Cunningham, and assigned to the same assignee as is the present application.

DESCRIPTION OF THE DRAWING

In the drawing accompanying this specification and forming part of this application there is shown, for purposes of illustration, an embodiment which my invention may assume and in this drawing.

DESCRIPTION OF THE PREFERRED EMBODIMENT

Figure 1:
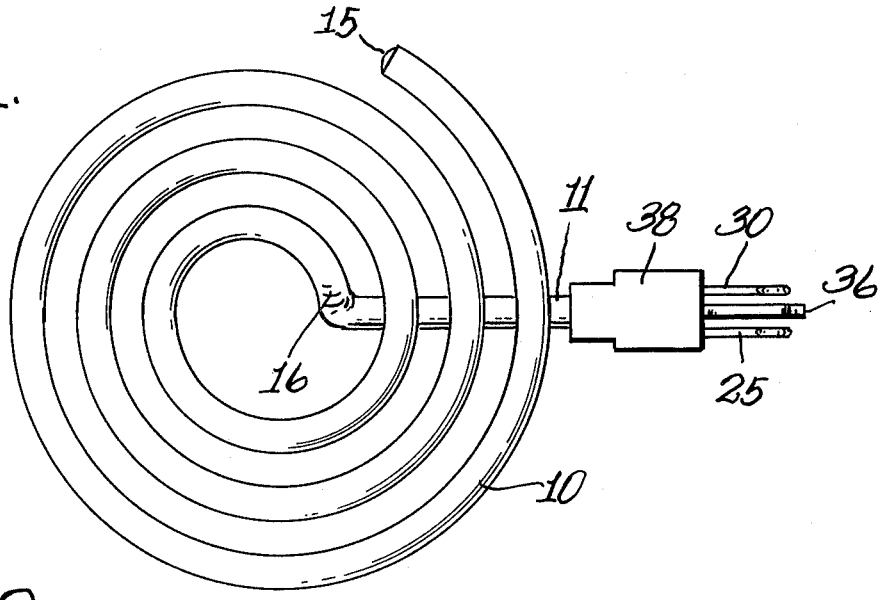
FIG. 1 is a small-scale, plan view of a surface unit, showing my improved termination attached thereto.

The surface unit herein disclosed comprises a metal sheath 10 which is initially rectilinear during early stages of manufacture, but is subsequently formed to a flat spiral active heating portion with a terminal portion 11 extending downwardly from the spiral and laterally and outwardly from the center thereof.

Contained within the sheath 10 is a coiled resistance wire 12 which is electrically insulated from the sheath by compacted refractory material 14. One end of the sheath is closed by a metal disc 15 which is welded in place to hermetically seal this end of the sheath.

Figure 2:
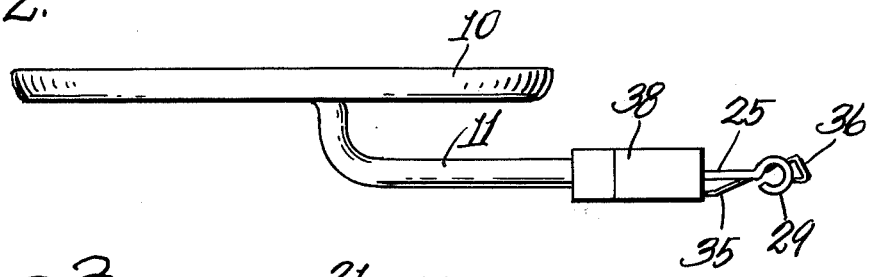
FIG. 2 is a side elevational view of the same.

The terminal portion 11 of the surface unit constitutes the so-called cold end of the sheath in that the heating resistor does not extend therwithin, and this cold end extends to about the place designated by the numeral 16 in FIG. 2.

As disclosed in the said Cunningham patent, a conductor 17 is disposed centrally within the resistance coil 12 and, at the end closed by the disc 15, is joined to the adjoining end of the coil 12, and thus constitutes a return conductor for that end of the coil. The conductor 17 extends throughout the length of the sheath and has an outer end 18 which terminates outwardly of that end of the sheath which is opposite that closed by the disc 15, such opposite end being shown at 19 in FIG. 3. The sheath 10 may be formed of Alloy 50; the resistance conductor 11 may be of Nichrome A wire; and the return conductor 17 may be of 16 C Nichrome wire.

In order to provide a conductor for the end of the resistor coil at the end opposite to that end which is connected to the return conductor, I provide a metal tube 20 which may be formed of Alloy 50. The inner end of the tube is telescoped within the adjoining end of the resistor coil and the latter is welded, brazed, silver-soldered or otherwise secured to the tube in good electrical continuity. The outer end of the tube extends outwardly of the sheath, as shown at 21. The tube 20 is of a length substantially equal to the length of the cold end of the sheath.

Figure 3:
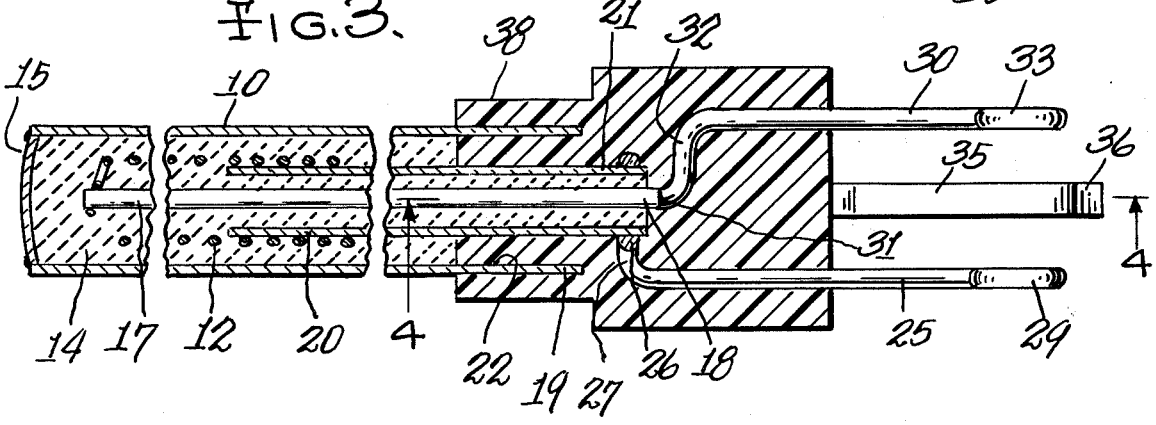
FIG. 3 is an enlarged, fragmentary, sectional view corresponding to the line 3—3 of FIG. 4.

As seen in FIG. 3, refractory material insulates the conductor tube 20 from the sheath 10, and the tube 20 from the return wire 17. This refractory material may be in the form of larger diameter refractory sleeves slipped over the tube 20 and the outer diameter of the resistor coil 12, and smaller diameter refractory sleeves slipped over the return wire 17 and within the tube 20 and coil 12, when the sheath is in recilinear form. The sheath is then subjected to a swaging, rolling or side-pressing operation to reduce its diameter and thereby crush the sleeves to a homogenous rock-like hardness. The refractory material 14 stops short of filling the end 19 of the sheath, to leave an opening 22 thereat, and this opening may result from removal of the usual bushing used to prevent escape of the refractory material prior to the time it is compacted.

To provide an electrical connection for the tube 20, I utilize a nickel-plated steel pin 25 having an inner end in the form of a loop 26 which encircles the adjoining end of the tube and is brazed, silver-soldered, welded or similarly joined thereto to form a good electrical connection. The pin 25 has an offset 27 adjoining the loop 26, as seen in FIG. 3. The outer end of the pin 25 is adapted for electrical connection with a contact contained within a receptacle 28 of a type shown in said Ammerman-Cunningham Pat. No. 3,447,121, and this outer end may be formed to buttonhook shape, as shown at 29.

To provide electrical connection for the return wire 17, I utilize a nickel-plated steel pin 30 having an inner end butted against the end 18 of the wire, as shown at 31 and brazed, silver-soldered, welded or similarly joined thereto to form a good electrical connection. The pin 30 has an offset 32 which extends in a direction opposite to the offset 27 to provide adequate electrical clearance between the pins 25 and 30. The outer end of the pin 30 may also be formed to buttonhook shape, as shown at 33.

In order to ground the sheath, I provide a strip 33 of nickel-plated steel, having its inner end brazed, silver-soldered, welded or similarly joined to the exterior surface of the sheath, as shown at 34. The inner portion of the strip 33 is straight, and the outer portion angles upwardly toward a plane through the centerlines of the pins 25, 30, as seen at 35 in FIG. 4. The outer extremity of the strip may be bent to triangular shape, as shown at 36, so that a portion thereof is in advance of the loops 29 and 33, and engages the ground contact within the receptacle 28 before the loops engage their respective contacts.

To complete the termination, a plastic cover 38 is molded over the sheath end 19, the tube end 21, the pins 25 and 30, and the strip 33, to encapsulate the same, except for the projecting parts of the pins and strip. This may be accomplished by either injection or transfer molding, and the material found suitable for the purpose is Durez 638 or equivalent. After molding, the cover 38 provides a rigid plug that firmly holds all parts in predetermined position.

Figure 4:
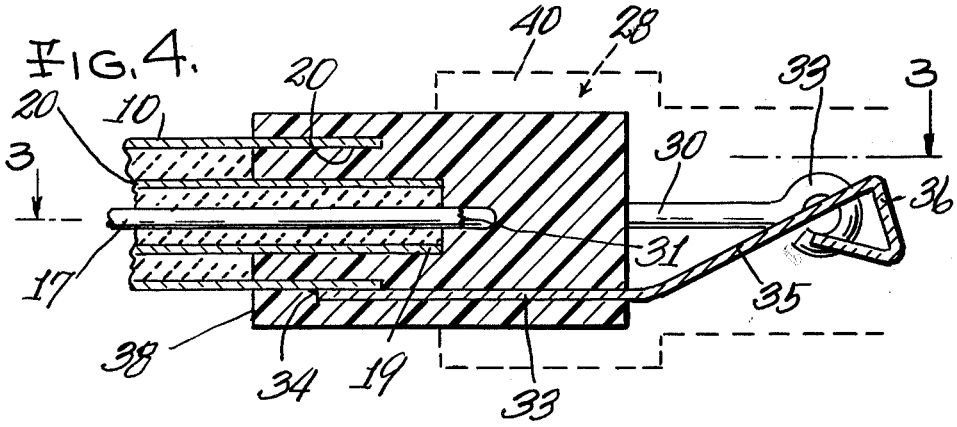
FIG. 4 is a fragmentary sectional view corresponding to the line 4—4 of FIG. 3.

The receptacle 28, which carries the contacts, is also formed of molded plastic and, as shown in FIG. 4, has a sleeve portion 40 which fits over an end of the plastic cover 38 to exclude spills, dirt and other contaminants from entering the receptacle.

I claim:

1. An electric heating element, comprising:

a tubular metal sheath, closed at one end, a helically coiled resistance conductor disposed centrally within said sheath, material within said sheath to electrically insulate said resistance conductor from said sheath and to conduct heat from said conductor to said sheath, a metal tube of smaller diameter than said sheath, said tube being insulated from said sheath and having portions extending inwardly and outwardly of the opposite end of said sheath, said inwardly extending portion being electrically connected to one end of said helically coiled resistance conductor and said outwardly extending portion providing one terminal end, a return conductor extending longitudinally within and insulated from said helically coiled resistance conductor and electrically connected to the latter at the opposite end thereof, said return conductor having a portion extending through said tube in insulated manner, and extending from the terminal end of said tube to provide another terminal end, a pair of terminal pins, one electrically connected to said tube terminal end and the other terminal pin electrically connected to said return conductor terminal end, said terminal pins being spaced apart and connectable to a source of electrical energy, and a rigid plastic block molded over said sheath opposite end and encapsulating portions of said terminal pins adjoining their connections with said tube terminal end and said return conductor terminal end, and rigidly holding said terminal pins in spaced relation.

2. The construction according to claim 1 wherein one terminal pin has a portion fused to the exterior surface of said tube, and the other terminal pin has a portion fused to said return conductor terminal end.

3. The construction according to claim 2 wherein said terminal pins have offset portions extending in opposite directions to provide electrical clearance therebetween, said offset portions being encapsulated by said plastic block.

4. The construction according to claim 3 wherein a metal member has one end electrically connected to said sheath opposite end, an intermediate portion encapsulated by said plastic block and an opposite end extending outwardly of said block for engagement with a contact which is connectable to ground.

* * * * *